United States Patent [19]

Boggs

[11] 3,970,046

[45] July 20, 1976

[54] VETERINARY SURGICAL METHOD

[76] Inventor: George L. Boggs, 2507 W. Hibbard, Rte. 5, Owosso, Mich. 48867

[22] Filed: Apr. 18, 1974

[21] Appl. No.: 461,863

[52] U.S. Cl. ..... 119/103

[51] Int. Cl.[2] ..... A61D 3/00

[58] Field of Search ..... 119/103; 269/322, 323, 269/324, 326, 328

[56] References Cited

UNITED STATES PATENTS

| | | | |
|---|---|---|---|
| 858,830 | 7/1907 | Sheeley | 119/103 |
| 2,967,510 | 1/1961 | Stoody | 119/103 |
| 3,590,784 | 7/1971 | Fly | 119/103 |
| 3,771,782 | 4/1973 | Anderegg | 119/103 X |

*Primary Examiner*—Louis G. Mancene
*Assistant Examiner*—J. N. Eskovitz
*Attorney, Agent, or Firm*—Whittemore, Hulbert & Belknap

[57] ABSTRACT

A veterinary surgical table for large animals is positioned in an operating room adjacent a recovery stall, and a chute positioned between the surgical table and the recovery stall; a large animal is secured to the vertically extending top of the surgical table in a standing position, the surgical table is tilted to a horizontal position for operating on the animal, and the surgical table is further tilted through a predetermined angle to permit sliding the animal from the surgical table onto the chute and into the recovery stall after the operation whereby lifting of the animal is eliminated.

4 Claims, 9 Drawing Figures

FIG.1
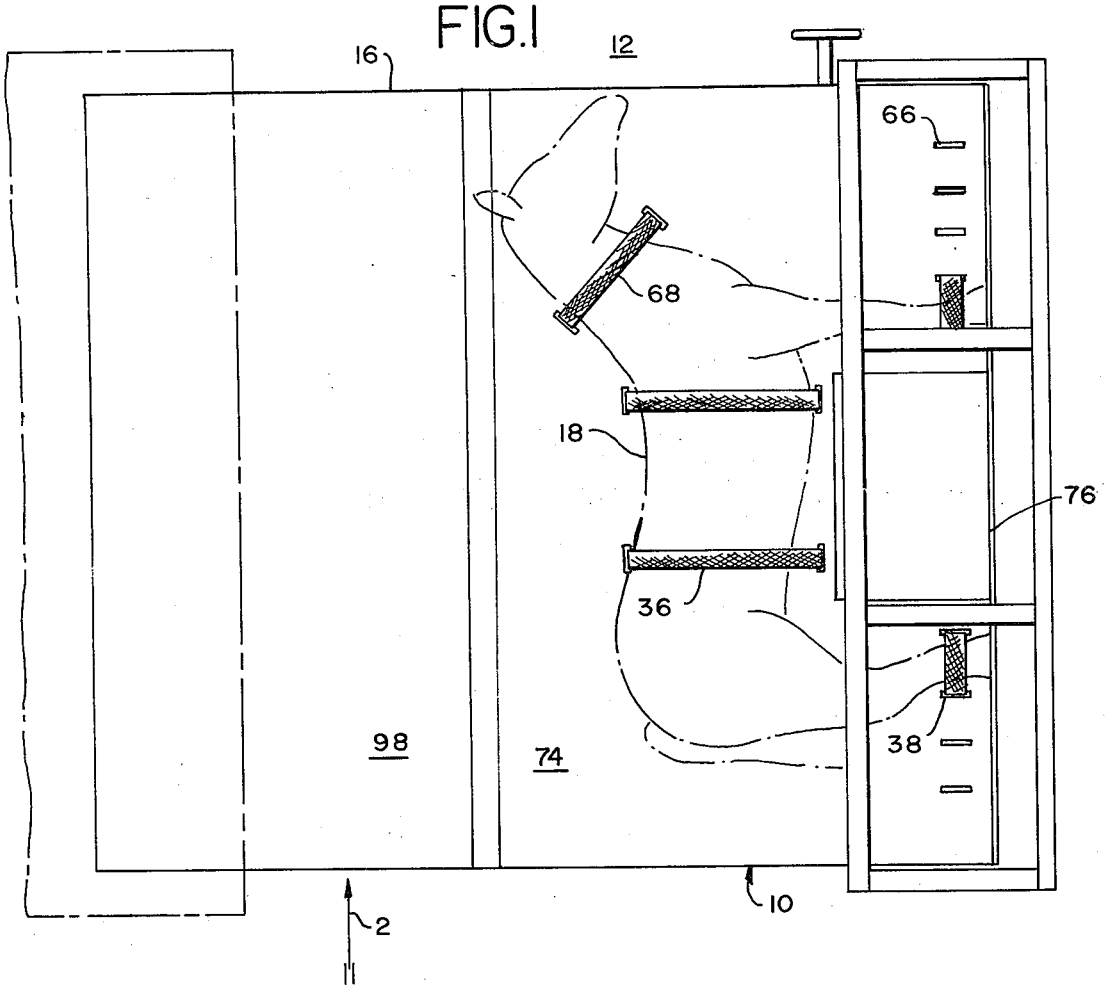
FIG.3
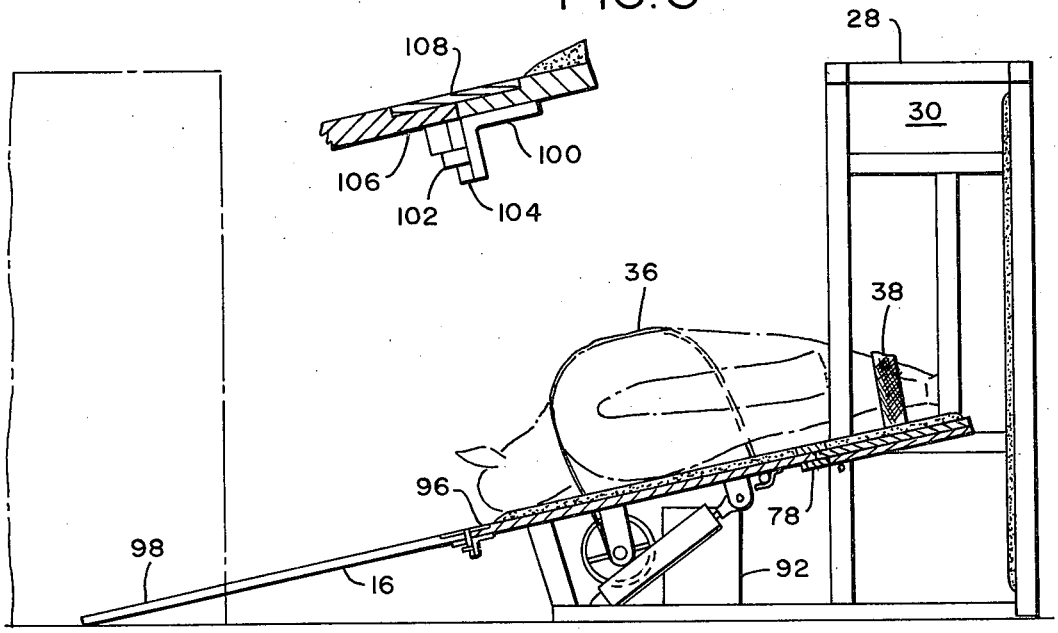
FIG.2

FIG. 4
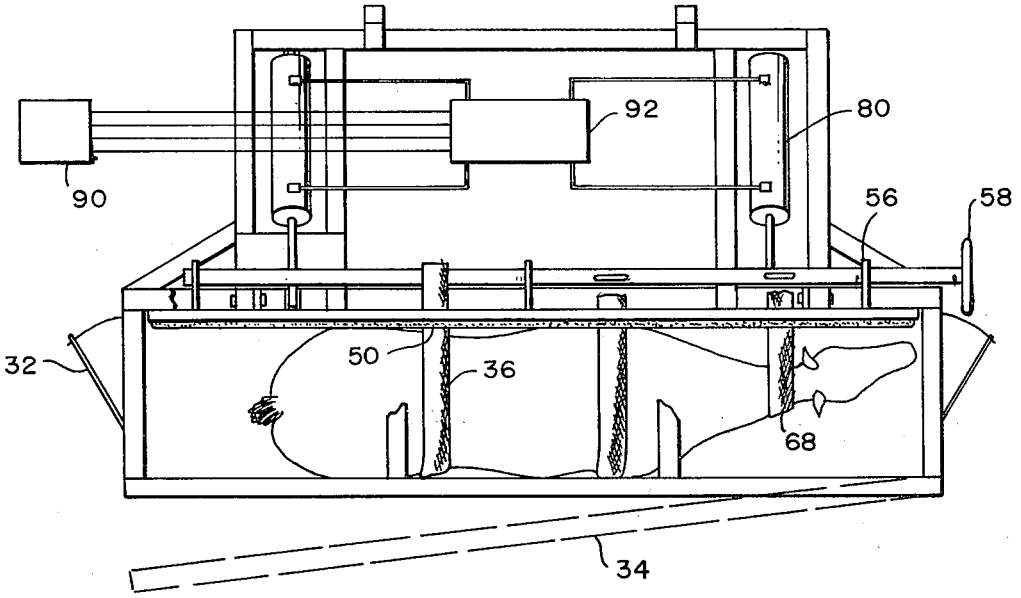
FIG. 6
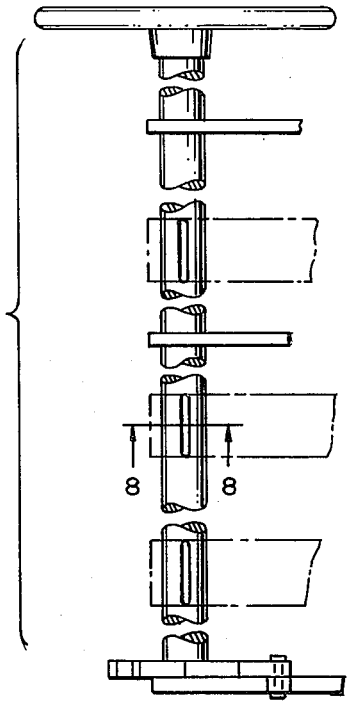
FIG. 5
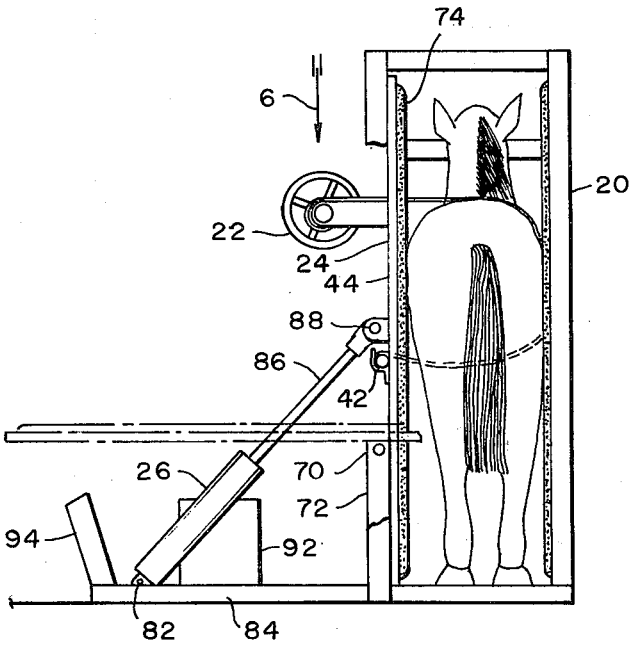
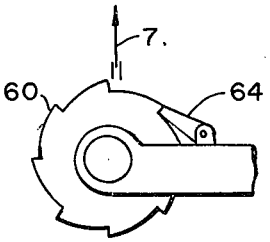
FIG. 7
FIG. 8
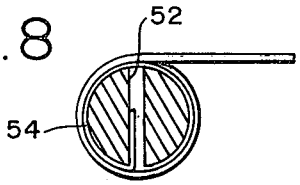
FIG. 9
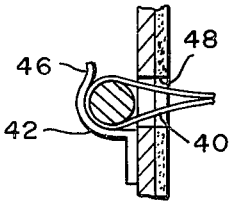

VETERINARY SURGICAL METHOD

BACKGROUND OF THE INVENTION

1. Field of the Invention

The invention relates to surgical tables and refers more specifically to a veterinary surgical table, which table is capable of being pivoted from the vertical position approximately 120° through the horizontal position to align the table with a chute which may be secured to the table, all of which provides for movement of an animal from a standing position before surgery into an operating position, and subsequently into a recovery stall located adjacent the operating room without lifting the animal.

2. Description of the Prior Art

In the past, veterinary surgical tables have been known which will move an animal from a vertical position into a horizontal position in preparing the animal for surgery. However, in the past, after the operation has been completed, it has been necessary to physically lift the animal and carry it to a recovery room or stall. The lifting of large animals such as horses after operations has been a particular problem in the past, requiring expensive and rather complicated equipment as well as a considerable amount of physical work.

Also, veterinary surgical tables of the past, wherein they have been movable at all, have generally been limited to a movement through 90°; that is, from the vertical to the horizontal, at most. Further, such tables in the past have often been complicated, relatively expensive, and sometimes inefficient in, for example, the manner of getting a large animal such as a horse in anesthetized condition onto and off of the table.

SUMMARY OF THE INVENTION

In accordance with the present invention, an improved surgical table is provided for use in a veterinary operating room for large animals, which operating room is adjacent to a recovery stall, and structure including a chute in combination with the surgical table for sliding the animal under anesthetic from the surgical table after an operation into the recovery stall.

The veterinary surgical table of the invention has a table top which is selectively movable from the vertical position through the horizontal position and into a position inclined to the vertical in sequence. The surgical table is further provided with unique structure for securing the animal in a standing position to the table in a vertical position. The table is further provided with a removable portion for providing ready access to the abdominal area of the animal to be operated on. Unique coupling structure is provided between the chute and surgical table to permit rapid securing of the chute to the table and movement of the animal from the table onto the chute without injury to the animal.

BRIEF DESCRIPTION OF THE DRAWINGS

FIG. 1 is a plan view of the veterinary surgical table in an operating room adjacent a recovery stall in combination with a chute extending from the surgical table into the recovery stall.

FIG. 2 is an end view of the surgical table and chute illustrated in FIG. 1 taken in the direction of arrow 2 in FIG. 1.

FIG. 3 is an enlarged portion of FIG. 2 at the connection between the surgical table and chute.

FIG. 4 is a top view of the veterinary surgical table of the invention.

FIG. 5 is an end view of the veterinary surgical table with the table in a vertical position and showing the alternate horizontal position of the table in phantom.

FIG. 6 is an enlarged broken view of a portion of the veterinary surgical table of FIG. 5 taken substantially in the direction of arrow 6.

FIG. 7 is an end view of the portion of the veterinary surgical table illustrated in FIG. 6 taken in the direction of arrow 7 in FIG. 6.

FIG. 8 is a cross section view of the portion of the veterinary surgical table illustrated in FIG. 6 taken substantially on the line 8—8 in FIG. 6.

FIG 9. is an enlarged view of a portion of the veterinary surgical table of FIG. 5, particularly showing the means for securing one end of the restraining bands to the back side of the top of the surgical table.

DESCRIPTION OF THE PREFERRED EMBODIMENT

As shown best in FIG. 1, the improved surgical table 10 of the invention is positioned in an operating room generally indicated 12 which is adjacent a recovery stall generally indicated 14. The surgical table 10 is shown in FIG. 1 in combination with a chute 16 for use in sliding an animal 18 from the operating table 10 in the operating room 12 into the recovery stall 14 on the chute 16.

In more detail, the veterinary surgical table 10 includes a stall 20 into which a large animal 18 such as a horse to be operated on may be placed in a standing position, means 22 for securing the animal 18 to the top 24 of the veterinary surgical table 10, and means 26 for pivoting the top 24 of the surgical table from the vertical position as shown in FIG. 5 through the horizontal position indicated in phantom in FIG. 5 and into the position illustrated in FIG. 3 wherein the surgical table is tilted approximately 15° from the horizontal position to permit sliding of the animal 18 from the surgical table 10.

The stall 20 includes a frame 28 as shown defining a generally rectangular stall of sufficient size to accommodate the animal 18. Suitable panels 30 of plywood or the like may be used to enclose the frame 28, where desired. With an enclosed frame, doors 32 may be positioned at convenient places in the stall 20 to permit access to the animal 18 for treatment of the animal in a standing position. The stall 20 is further provided with the door 34 through which the animal 18 is positioned in the stall.

The structure for securing the animal to the table top 24 includes a pair of restraining bands 36 adapted to pass around the central portion of the animal, as shown best in FIGS. 4 and 5, and straps 38 for securing the extremities of the animal to the table.

The straps 36 are each provided with a loop 40 in one end thereof which receive a pipe-like member 42 therethrough which is secured on the back 44 of the surgical table by means of the brackets 46, as shown in FIG. 9. The other ends of the restraining straps 36 are passed through slots 48 in the table top 24 and are subsequently passed around the animal 18 beneath its abdomen and over its back. The straps are then again passed through openings 50 in the table top 24 and are then passed through a slot 52 extending through the diameter of the cylinder 54.

The cylinder 54 is supported for rotation in bearing brackets 56 from the back 44 of the table top 24. A wheel 58 is provided on one end of the cylinder 54, while a ratchet 60 operable in conjunction with a spring-biased pawl 64 is provided on the other end of the cylinder 54. Thus, on rotation of the wheel 58, the cylinder 54 is caused to turn to tighten the restraining bands 36 to secure the animal 18 to the table top 24. The table top 24 may be released only on pivoting the pawl 64 out of engagement with the ratchet 60 in opposition to the pawl bias.

The straps 38 may be any usual buckle type straps which are adapted to fit through the slots 66 in the table top 24 which are variably positioned to accommodate different size animals 18.

A strap 68 is also provided for securing the animal's head in a fixed position on the table top 24. Strap 68 may either be connected to the cylinder 54, as shown in FIG. 4 or it may be a separate buckle strap or the like such as the straps 38, if desired.

The requirements of straps 38 and 68 are that they restrain the animal's legs and head in a fixed position without injuring the animal. The restraining bands 36 must support the primary weight of the animal during pivoting of the surgical table 10.

The table top 24 is pivotally mounted by pivot means 70 to the vertically extending frame members 72 adjacent each end of the stall 20. Table top 24 is a substantially flat rectangular member which may be constructed of any desired material such as wood or metal to support the weight of the animal 18. A pad 74 which is soft enough to prevent injury to an animal lying on the pad, and which will allow sliding of the animal off the pad and at the same time permit easy cleaning of the pad, is provided on the table top 24 as shown. The pad may, for example, be a plastic-covered foam rubber pad.

As best shown in FIGS. 1 and 2, a rectangular portion 76 is removable from the table top 24 to permit a veterinarian to get closer to the abdomen of the animal 18 in the case of abdominal surgery. The rectangular portion 76 of the table top 24 is provided with peripheral members 78 on both the bottom and the top thereof, as shown best in FIG. 3, which form a groove into which the edge of the rest of the table top 24 about the portion 76 thereof fits as a tongue to retain the rectangular portion 76 in assembly with the rest of the table top 24 as shown. Suitable detents (not shown) may be provided to secure the portion 76 to the rest of the table top 24, as desired.

The structure 26 for pivoting the table top 24, as shown, includes a pair of piston and cylinder structures 80, one at each side of the table top 24. Pivot means 82 are provided at one end of the piston and cylinder structures for securing the piston and cylinder structures 80 to the frame members 84. A piston rod 86 extends out of the other end of the piston and cylinder structures 80 and is pivotally connected to the table top 24 centrally of each side thereof by pivot means 88. The piston and cylinder structures 80 may be hydraulically activated and are actuated together from a suitable control panel 90 to cause hydraulic fluid to pass from the reservoir 92 into and out of the piston and cylinder structures 80 in accordance with normal engineering practices to extend or retract the piston rods 86 and thus cause pivoting of the table top 24 about the pivot mounting 70 thereof.

The movement of the table top 24 on actuation of the piston and cylinder structures 80 may be from the vertical position, as shown in FIG. 8, in which the animal 18 is first secured to the table top 24 into a horizontal position, as shown in phantom in FIG. 5, in which position an operation on the animal 18 may be carried out and subsequently into the position in FIG. 3 where the table top 24 is again tilted in the same direction approximately 15° to permit sliding of the animal 18 on the chute 16 into the recovery stall 14. In the fully down position, the table top 24 rests on the frame members 94, as shown best in FIG. 3.

The chute 16 again is a substantially flat rectangular member which may be of suitable material such as metal or wood capable of sustaining the weight of the animal 18. The chute 16 is secured to the edge 96 of the table top 24 when it is desired to slide the animal 18 from the table top 24 over the chute and into the recovery stall 14. The chute 16 is positioned at approximately 15° to the horizontal when secured to the edge 96 of the table top 24, as shown best in FIG. 3. Further, the chute 16 is provided with a cover 98 thereon which is easily cleaned and has a low coefficient of friction so that the animal may be slid down the chute to the stall with a minimum of effort. The cover 98 may be of any relatively dense, non-porous plastic material having the desired coefficient of friction.

The structure for securing the chute 98 to the edge 96 of the table top 24, as shown best in FIG. 3, includes an L-shaped mamber 100 secured to the edge 96 of the table top 24 having eyelets 102 secured thereto in spaced apart locations therealong, and L-shaped finger members 104 secured to the edge 106 of the chute 98 at similarly spaced apart locations therealong adapted to fit within the eyelets 102. To insure smooth sliding of the animal 18 from the table top 24 to the chute 106, a flap 108 of high friction material is secured to the edge 96 of the table top 24, as shown best in FIG. 3, by convenient means (not shown) and extends beyond the edge 96 of the table top 24 to overlap the edge 106 of the chute 98. The flap 108 also serves to inhibit the accidental removal of the edge 106 of the chute 98 from the edge 96 of the table top 24.

In overall use of the veterinary surgical table 10, an animal such as a horse to be operated on is lead into the stall 10 with the table top 24 in a vertical position as shown in FIG. 5. The restraining straps 36 are secured about the body of the animal 18 by means of the pipe 42 passing through ends 40 of the straps and the structure 22 securing the other ends of the straps to hold the animal 18 tightly. The head of the animal 18 may then be supported by means of the strap 68 and the animal anesthetized, after which the animal's feet may be secured in position by the straps 38. The table top 24 is then tilted from the vertical position shown in FIG. 5 to the horizontal position shown in phantom in FIG. 5, and the animal is operated on with the portion 76 of the table top 24 removed, if necessary.

After the operation is completed, the table top 24 is further tilted an additional amount of approximately 15°, as shown in FIG. 3, the chute 98 is secured to the table top 24 in the position shown in FIG. 3, and the animal is released from the restraints on the surgical table 10 and is slid from the table top 24 over the chute 98 into the recovery stall 14 adjacent the operating room 12.

While one embodiment of the present invention has been considered in detail, it will be understood that other embodiments and modifications are contemplated by the inventor. It is the intention to include all such embodiments and modifications as are defined by the appended claims within the scope of the invention.

What I claim as my invention is:

1. The method of moving a large animal before and after operating on the animal comprising securing the animal in a standing position to a vertically positioned operating table, tilting the operating table to a horizontal position for performing an operation on the animal, further tilting the operating table in the same direction approximately 15° to permit sliding of the animal from the operating table, attaching a chute to the operating table and sliding the animal between the operating table and a recovery stall on the chute.

2. The method as set forth in claim 1 wherein the securing of the animal to the operating table includes sliding an elongated mamber through a loop on one end of a restraining band at the back of the operating table, placing the elongated member on brackets on the back of the operating table, passing the restraining band through the operating table around a portion of the animal and back through the operating table and around a cylindrical member and subsequently rotating the cylindrical member to tighten the band around the animal.

3. The method as set forth in claim 1 wherein the tilting of the table is accomplished by the step of applying hydraulic pressure to extensible links secured to the table at both sides thereof to produce tilting of the table about a pivot connection for the table at both sides of the table.

4. The method as set forth in claim 1 and further including the step of removing a portion of the operating table to permit movement of a veterinarian closer to the animal.

* * * * *